US005409413A

United States Patent [19]

Hou

[11] Patent Number: 5,409,413

[45] Date of Patent: Apr. 25, 1995

[54] ROCKING DISPLAY ASSEMBLY

[75] Inventor: Jack Hou, Taipei, Taiwan, Prov. of China

[73] Assignee: Giftec, Ltd., Taipei, Taiwan, Prov. of China

[21] Appl. No.: 259,132

[22] Filed: Jun. 13, 1994

Related U.S. Application Data

[63] Continuation of Ser. No. 62,259, May 17, 1993, abandoned, which is a continuation of Ser. No. 827,489, Jan. 30, 1992, abandoned, which is a continuation of Ser. No. 581,329, Sep. 12, 1990, abandoned, which is a continuation of Ser. No. 467,172, Jan. 19, 1990, Pat. No. 4,995,845.

[51] Int. Cl.[6] ..... A63H 13/18; A63H 15/06

[52] U.S. Cl. ..... 446/325; 472/95; 52/DIG. 6

[58] Field of Search ..... 446/325, 326, 396, 330, 446/331, 322, 323, 268, 241, 314, 315, 352, 489; 472/95, 102, 135; 52/715, 714, 712, 696, DIG. 6

[56] References Cited

U.S. PATENT DOCUMENTS

| | | | |
|---|---|---|---|
| 650,675 | 5/1900 | Eldridge | 446/396 |
| 1,133,719 | 3/1915 | Furrow | 446/241 |
| 1,309,838 | 7/1919 | Bonnet | 446/326 |
| 1,815,183 | 7/1931 | Brown et al. | 446/326 |
| 1,915,697 | 6/1933 | Robinson | 52/696 |
| 2,443,354 | 6/1948 | Johnson | 446/314 |
| 2,658,306 | 11/1953 | Holt, Jr. | 446/314 |
| 3,172,171 | 3/1965 | Knight | 52/DIG. 6 X |
| 3,395,482 | 8/1968 | Sarro | 446/241 |
| 3,612,532 | 10/1971 | Strongin | 446/241 X |
| 3,710,506 | 1/1973 | Thornell | 446/314 X |
| 3,736,718 | 6/1973 | Sylvan | 52/DIG. 6 X |
| 4,241,557 | 12/1980 | Jensen | 52/696 |
| 4,939,944 | 7/1990 | Hou | 446/330 X |
| 4,971,593 | 11/1990 | Mayhall et al. | 446/268 |
| 4,995,845 | 2/1991 | Hou | 446/396 X |
| 5,097,645 | 3/1992 | Sanderson | 446/126 X |
| 5,310,380 | 5/1994 | Levy et al. | 446/489 |

FOREIGN PATENT DOCUMENTS

| | | | |
|---|---|---|---|
| 580727 | 10/1976 | Switzerland | 52/DIG. 6 |

OTHER PUBLICATIONS

Willitt, Catalog, pp. 13/14, 1987.
Willits Catalog, pp. 3/4, T. Fraley, 1986.

*Primary Examiner*—Robert A. Hafer
*Assistant Examiner*—D. Neal Muir
*Attorney, Agent, or Firm*—Bacon & Thomas

[57] ABSTRACT

An ornamental figure is mounted on a vertical support rod extending upwardly from a rocker base assembly comprised of a cross plate, a pair of cross braces and a pair of rocker members which may be quickly assembled without requiring glue or fasteners.

11 Claims, 2 Drawing Sheets

ROCKING DISPLAY ASSEMBLY

This application is a continuation of application Ser. No. 08/062,259, filed May 17, 1993, now abandoned, which is a continuation of Ser. No. 07/827,489, filed Jan. 30, 1992, now abandoned, which is a continuation of Ser. No. 07/581,329, filed Sep. 12, 1990, now abandoned, which is a continuation of Ser. No. 07/467,172, filed Jan. 19, 1990, now U.S. Pat. No. 4,995,845.

BACKGROUND OF THE INVENTION

1. Field of the Invention

The present invention generally involves the field of technology pertaining to devices for displaying ornamental articles. More specifically, the invention relates to an improved unit for displaying an ornamental figure and imparting a desired movement thereto.

2. Description of the Prior Art

Devices for displaying ornamental articles, such as ceramic and porcelain figures, are well known. Such devices may comprise a simple stationary display unit or a more complex unit capable of imparting various motions to the figure being displayed. These display units are usually finely detailed, present a quality appearance and are normally sold through gift and specialty stores.

The manufacture of such display units usually requires that the individual components forming the unit be fabricated and assembled at different locations having minimum labor costs in order to maximize profits to the manufacturer. It is therefore important that the design and construction of a display unit be such as to provide both efficiency in manufacture and quality in appearance.

SUMMARY OF THE INVENTION

It is an object of the present invention to provide an improved unit for displaying an ornamental article.

It is another object of the invention to provide an improved display unit capable of imparting a rocking motion to an ornament.

It is a further object of the invention to provide an improved rocking display unit for an ornamental article wherein the unit may be efficiently assembled from manufactured components in an economical manner and provide a high quality appearance.

These and other objects of the invention are realized by providing a rocking display unit which includes a pair of rocker members maintained in a spaced disposition by a pair of cross braces having their opposite ends frictionally engaged within corresponding holes provided at opposite ends of the members. A cross plate is positioned between the rocker members substantially midway between the opposite ends thereof. The cross plate is provided with oppositely directed prongs which are frictionally engaged within corresponding holes provided in the rocker members. A support rod is secured to the cross plate by inserting a threaded lower end thereof through an aperture in the plate and engaging same with a threaded locking member. An ornament is slidably received on the support rod and mounted in a desired position thereon by a resilient grommet.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
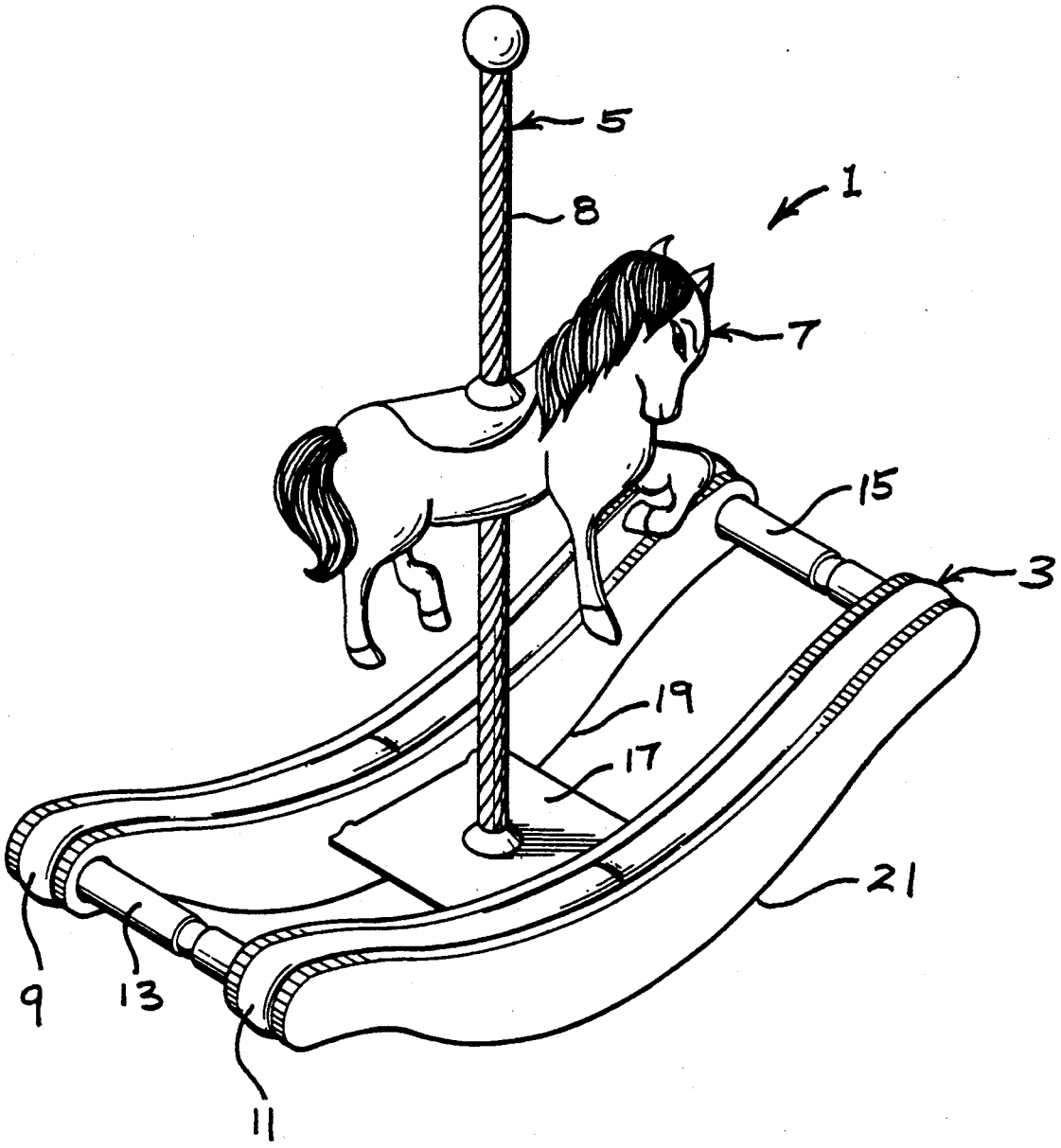
FIG. 1 is a perspective view showing an assembled rocking display unit according to a preferred embodiment of the invention.

A rocking display unit 1 according to a preferred embodiment of the invention is shown in FIG. 1 and essentially includes a rocker base assembly 3 and a support rod 5 extending upwardly therefrom for mounting an ornament 7 to a main section 8 of rod 5. Base assembly 3 is formed from a pair of opposed elongate rocker members 9 and 11 which are secured together in a spaced parallel disposition by a pair of transverse cross braces 13 and 15, and a cross plate 17 to which rod 5 is secured. Cross plate 17 is positioned midway between the ends of members 9 and 11, the latter also being provided with a pair of appropriately curved bottom surfaces 19 and 21, respectively, to permit the imparting of a rocking motion to base assembly 3 when the latter is supported on a flat surface.

Ornament 7 is depicted in the form of a horse figure, which is preferably made of ceramic or porcelain material. However, ornament 7 may also be of any other desired configuration and formed of other appropriate materials if so desired. For the practice of the invention, it is preferred that ornament 7 be of substantially hollow construction for purposes which shall be later described herein.

The details of the components and the manner in which they are assembled together to form display unit 1 shall now be described with reference to FIG. 2. As shown therein, cross braces 13 and 15 are each preferably of an elongate cylindrical configuration and secured to rocking members 9 and 11 by inserting the opposite ends of braces 13 and 15 within two pairs of opposed inwardly directed holes 23 and 25 formed in opposite ends of rocker members 9 and 11, though only a single each of holes 23 and 25 are depicted. Holes 23 and 25 should be sized smaller than the opposite ends of braces 13 and 15 in order to achieve a tight interference fit therebetween. Accordingly, rocker members 9 and 11 may be formed of wood, and it is also preferred that cross braces 13 and 15 be formed of wood.

Cross plate 17 is preferably formed of metal and provided with two pairs of oppositely directly sharpened flat prongs 27 and 29. Prongs 27 are forcibly engaged within a pair of corresponding and appropriately sized prong holes 30 formed in rocker member 9, while prongs 29 are also engaged within a pair of similar prong holes (not shown) formed in rocker member 11. Though it is preferred that plate 17 be provided with prongs 27 and 29, it is understood that other engagement means of different configurations may also be utilized to advantage for securing plate 17 to members 9 and 11. Plate 17 is further provided with a centrally positioned aperture 31 therethrough for a purpose to be hereinafter indicated.

Support rod 5 is preferably of cylindrical configuration and includes a first end formed by a reduced diameter section 33, the latter defining an annular wall section 35. Section 33 terminates in a threaded section 37. The second free end of rod 5 may terminate in a decorative member 39 of spherical or other configuration, and main section 8 of rod 5 may be provided with a decorative helical groove 41 extending therealong from member 39 to annular wall section 35.

Figure 2:
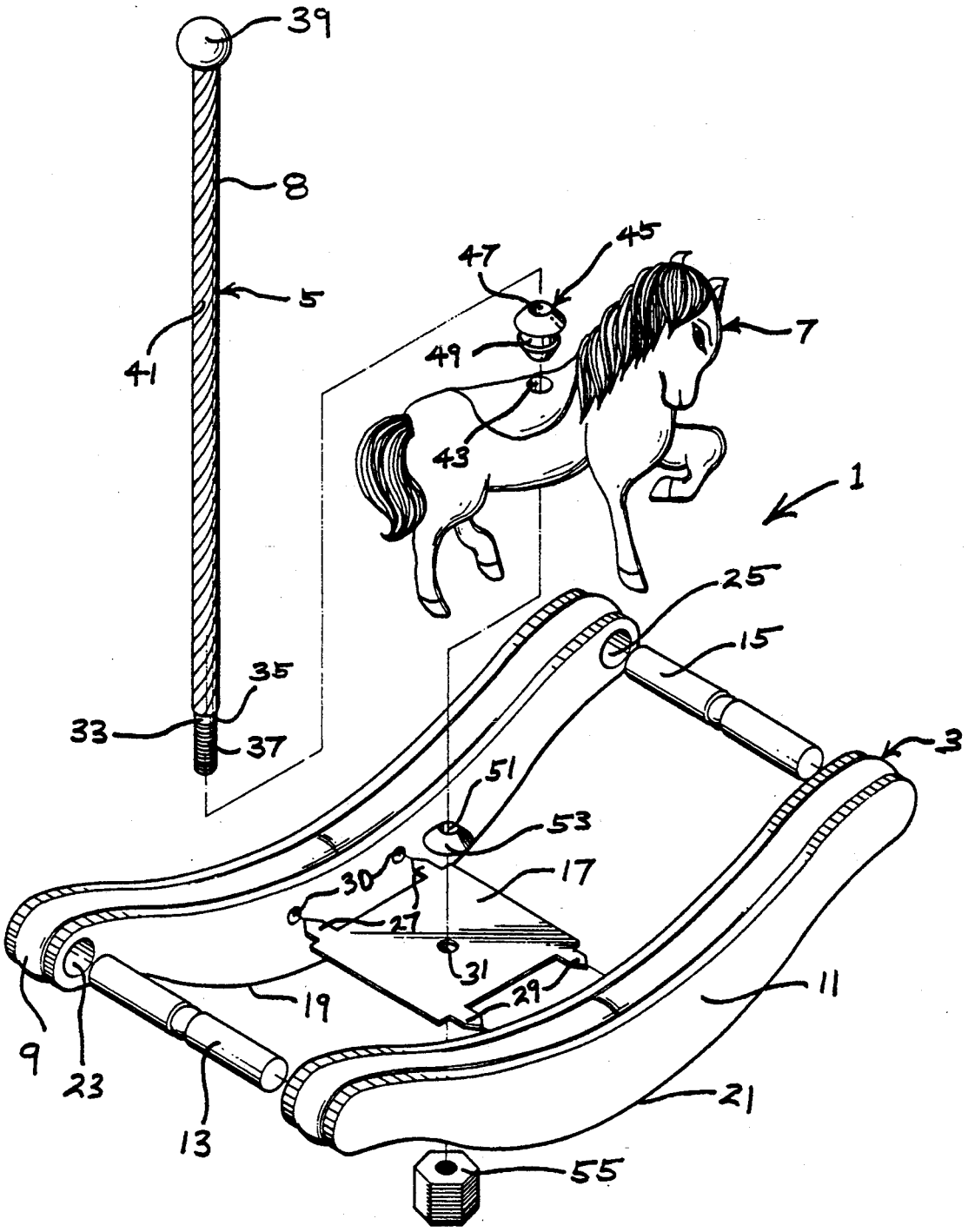
FIG. 2 is an exploded perspective view of the display unit, particularly depicting the individual components forming the unit and the manner in which they are assembled.

Ornament 7 is of hollow construction and includes a pair of coaxially aligned apertures 43 formed in opposed wall portions thereof, although only a single aperture 43 is shown in FIG. 2. Apertures 43 are sized to slidably receive main section 8 of support rod 5 therethrough. The mounting of ornament 7 in a fixed position on rod 5 is achieved by means of a resilient grommet 45 provided with a central passage 47 and an annular groove 49. Passage 47 is sized so that main section 8 of rod 5 may be slidably received therethrough and disposed in frictional engagement therewith in order to permit grommet 45 to be maintained in a desired position on rod 5. The width of groove 49 corresponds to the wall thickness of ornament 7 in the vicinity of aperture 43 so that the periphery of aperture 43 may be engaged within groove 49, thereby permitting ornament 7 to be mounted on rod 5 by grommet 45. It is preferred that grommet 45 be formed of rubber or similar resilient material. Though ornament 7 may be mounted on rod 5 through the use of grommet 45, it is understood that other means may also be utilized in the practice of the invention. For example, rod 5 may be formed in two pieces and secured together with a threaded shaft that extends through apertures 43 of ornament 7 and provided with appropriate washers on the exterior sides of apertures 43.

Once ornament 7 has been mounted on rod 5 in the manner previously described, reduced diameter section 33 of rod 5 is inserted through a central passage 51 of a washer member 53. Passage 51 is of substantially the same diameter as section 33, thereby causing washer member 53 to be disposed in abutting engagement against annular wall section 35. Threaded section 37 is inserted through aperture 31 of cross plate 17 and engaged by a threaded nut 55 on the opposite side of plate 17. Nut 55 is preferably weighted to assist in restoring rod 5 to a vertical position after any rocking motion of base assembly 3 has terminated. Aperture 31 is also of substantially the same diameter as section 33 of rod 5, so the engagement of annular wall section 35 against washer 53 limits the insertion of rod 5 through aperture 31 and permits its secure attachment to plate 17 through nut 55. Alternatively, aperture 31 may be threaded or provided with a threaded bushing, thereby eliminating the need for nut 55.

As is apparent, rocker base 3 may be economically manufactured and quickly assembled without requiring glue or special fasteners for securing rocker members 9 and 11 to cross braces 13, 15 and cross plate 17. The mounting of ornament 7 to support rod 5 by means of grommet 45 and the subsequent attachment of rod 5 to rocker base 3 are also economically and efficiently realized through the arrangement of the components described herein. It is further envisioned, in addition to the preferred embodiment described herein, that specific applications of the invention may require the use of glue or special fasteners for assembling rocker base 3.

Support rod 5, washer member 53 and cross plate 17 are preferably made of brass or other decorative material.

It is to be understood that the form of the invention herein shown and described is to be taken as a preferred embodiment thereof, and that various changes in shape, material, size and arrangement of parts may be resorted to without departing from the spirit of the invention or scope of the subjoined claims.

I claim:

1. A rocking display assembly comprising:

a) a support rod including a first end and a second end;

b) a base assembly including a pair of rocker members having curvilinear bottom surfaces configured for engaging a support surface and imparting a rocking motion to the base assembly and associated upper surfaces, a pair of cross braces secured to opposite sides of the rocker members for maintaining same in a spaced disposition, and a cross plate extending across the rocker members substantially midway between the opposite ends thereof;

c) the cross plate being formed to integrally include at least one sharpened prong-shaped member extending outwardly from each of two opposite sides thereof, at least one hole formed in an inside wall of each rocker member, and the cross plate being secured to the rocker members through forcible engagement of the prong-shaped members within the holes of the rocker members, said cross plate being secured vertically above said curvilinear bottom surfaces and below a lowermost portion of said associated upper surfaces of said rocker members;

d) means for securing the first end of the support rod to the cross plate; and e) an ornament mounted on the support rod.

2. The rocking display assembly of claim 1 wherein the means for securing the first end of the support rod to the cross plate includes:

a) an aperture formed through the cross plate;

b) the first end of the support rod including a threaded section extending through the aperture; and c) a corresponding threaded member disposed in threaded engagement with the threaded section.

3. The rocking display assembly of claim 1 wherein the cross plate includes a pair of sharpened metal prong-shaped members extending outwardly from each of the two opposite sides thereof and each rocker member includes a pair of holes formed in the inside wall thereof.

4. The rocking display assembly of claim 1 further including means for mounting the ornament in a desired position on the support rod.

5. The rocking display assembly of claim 4 wherein the mounting means includes:

a) the ornament having a pair of apertures formed in opposed wall portions thereof, with each aperture being defined by a peripheral edge;

b) the support rod extending through the pair of apertures; and c) at least one resilient grommet carried by the support rod and disposed in engagement with a peripheral edge of one aperture.

6. A rocking display assembly comprising:

a) a support rod including a first end and a second end;

b) a base assembly including a pair of rocker members having curvilinear bottom surfaces configured for engaging a support surface and imparting a rocking motion to the base assembly and associated upper surfaces, a pair of cross braces secured to opposite sides of the rocker members for maintaining same in a spaced disposition, and a cross plate extending across the rocker members substantially midway between the opposite ends thereof;

c) the cross plate being formed to integrally include at least one sharpened prong-shaped member extending outwardly from each of two opposite sides thereof, at least one hole formed in an inside wall of each rocker member, and the cross plate being secured to the rocker members through engagement of the prong-shaped members within the holes of the rocker members, said cross plate being secured vertically above said curvilinear bottom surfaces and below a lowermost portion of said associated upper surfaces of said rocker members;

d) means for securing the first end of the support rod to the cross plate;

e) an ornament mounted on the support rod; and f) weighting means carried by one of the base assembly and the support rod for restoring the support rod to a vertical position after termination of the rocking motion.

7. The rocking display assembly of claim 6 wherein the weighting means is secured to the first end of the support rod.

8. The rocking assembly of claim 6 wherein the means for securing the first end of the support rod to the cross plate includes:

a) a support rod mounting aperture formed substantially centrally through the cross plate;

b) the first end of the support rod including a threaded section extending through the aperture; and c) the weighting means includes a corresponding threaded member disposed in threaded engagement with the threaded section.

9. The rocking display assembly of claim 6 wherein the cross plate includes a pair of sharpened prong-shaped members extending outwardly from each of the two opposite sides thereof and each rocker member includes a pair of holes cooperating in the inside wall thereof.

10. The rocking display assembly of claim 6 further including means for mounting the ornament in a desired position on the support rod.

11. The rocking display assembly of claim 10 wherein the mounting means includes:

a) the ornament having a pair of apertures formed in opposite wall portions thereof, with each aperture being defined by a peripheral edge;

b) the support rod extending through the pair of apertures; and c) at least one resilient grommet carried by the support rod and disposed in engagement with a peripheral edge of one aperture.

* * * * *